United States Patent [19]

Hukill

[11] Patent Number: 4,597,209

[45] Date of Patent: Jul. 1, 1986

[54] CHANGEABLE DISPLAY DEVICE

[76] Inventor: Marlin E. Hukill, P.O. Box 466, Seymour, Ind. 47274

[21] Appl. No.: 526,656

[22] Filed: Aug. 26, 1983

[51] Int. Cl.[4] ..... G09F 3/04

[52] U.S. Cl. ..... 40/447; 40/530; 40/486

[58] Field of Search ..... 40/447, 450, 451, 530, 40/486, 488

[56] References Cited

U.S. PATENT DOCUMENTS

| | | | |
|---|---|---|---|
| 532,032 | 1/1895 | Dalumi . | |
| 554,837 | 2/1896 | Seibert . | |
| 567,379 | 9/1896 | Dalumi | 40/447 |
| 682,177 | 9/1901 | Dalumi . | |
| 950,912 | 3/1910 | Harrington . | |
| 1,004,810 | 10/1911 | Newell, Jr. . | |
| 1,679,520 | 8/1928 | Giroux | 40/447 |
| 1,731,164 | 10/1929 | Giroux . | |
| 1,752,251 | 3/1930 | Giroux . | |
| 1,765,215 | 6/1930 | Duchard . | |
| 2,628,838 | 2/1953 | Smalley . | |
| 2,814,893 | 12/1957 | Aiken . | |
| 3,410,011 | 11/1968 | Bowman . | |
| 3,458,944 | 8/1969 | Jimenez . | |
| 3,462,857 | 8/1969 | Glass et al. . | |
| 3,605,302 | 9/1971 | Moller . | |
| 3,706,148 | 12/1972 | Johnston . | |
| 3,740,878 | 6/1973 | Oelschlaeger . | |
| 3,949,392 | 4/1976 | Caritato | 40/447 |
| 3,975,728 | 8/1976 | Winrow | 40/447 |
| 4,063,377 | 12/1977 | Hukill . | |
| 4,223,464 | 9/1980 | Winrow | 40/447 |

*Primary Examiner*—Gene Mancene
*Assistant Examiner*—Wenceslao J. Contreras
*Attorney, Agent, or Firm*—Woodard, Weikart, Emhardt & Naughton

[57] ABSTRACT

A changeable display device comprising a support member created out of a plurality of parallel rails forming display channels and said rails being attached together by cross members. Oppositely colored rows of back plates are mounted to said rails. Display elements are rotatably mounted in an array in said display channels having opposite display sides. The display elements are rotated into either a first display orientation or second display orientation so that cooperating with said back plates a display may be formed. Each of the display elements has a camming member with a camming surface and elbow portions adjacent one of the rails and a C-shaped spring is disposed in a spring housing attached to the rails adjacent said camming member. The C-shaped spring is deformed by the action of the camming member and thus exerts a force against the camming member. This action of the camming member and the C-shaped spring results in a force which retains that display element in either of said first display orientation or said second display orientation and the spring also biases the display element into the first display orientation or the second display orientation.

17 Claims, 14 Drawing Figures

CHANGEABLE DISPLAY DEVICE

BACKGROUND OF THE INVENTION

The present invention relates to a changeabe display device having an array of display elements whose orientation may be altered to form various displays.

Many business establishments utilize signs to advertise prices of certain key items and other information. Gasoline filling stations, for example, generally advertise the price of gasoline, cigarettes or other products in this manner. Hotels, motels, automobile dealerships, and other roadside businesses similarly display prices or other information to the public. Because the prices or other information may vary with time, it is necessary that the sign be changeable to reflect these changes.

Some of the existing changeable signs provide for the numbers or letters to be removable from the basic structure of the sign. The sign is changed by removing the individual numbers or letters and replacing them with others. The individual characters are attached to the sign in a variety of ways. The users of signs of this type are required to select and store the proper combinations of numbers and letters to enable them to display the desired variety of messages. In situations where the display must be seen from great distances, the display characters for some signs may be quite large, some being as large as five feet tall. Characters of this size are particularly unwieldy to remove and attach to a sign, especially if the sign is disposed at a location at a great distance above the ground. In addition, one or more characters in a particular display sign may be removed or otherwise become detached from the sign, thereby making the sign display incomplete.

It is therefore desirable to have a changeable display device which does not incorporate detachable display characters. This has been accomplished by providing display devices which include an array or regularly shaped display elements. Each display element typically has at least two sides of contrasting colors, and an equal number of display positions in which one of the sides is viewable from the front of the device. Each individual character or number or letter in the display is formed by positioning the appropriate arrangement of display elements to form that number or letter. These types of displays may be formed by electronic digital displays but these require expenditures of electricity and complicated electronics. Other displays are made of simple mechanical display elements which once shifted into position are intended to remain, to provide the appropriate display.

The primary requirements for a changeable display device of the latter description are that the display device be of simple and durable construction, and that the display positions of the display elements be quickly and conveniently changed. Preferably, the changes of display positions of the display elements can be performed from a position remote from the sign, as where the sign is positioned high above the ground.

In addition, when a display device is positioned high above the ground or outdoors as is the custom of most of these display devices used by roadside businesses, it is necessary that the display device provide appropriate means for maintaining each of the display elements in the appropriately selected display position. These signs may be subjected to winds and other weather which would tend to exert forces which would move the display elements out of the desired display position if a means for maintaining them in the display position is not provided. This means which maintains the display elements in the desired display orientation or position should be of a type that allows the display elements to be changed easily by the user but should also provide a secure means for maintaining the display elements in the orientation once the user has made the selection.

The following are a group of patents which relate to changeable display devices of various types.

| Patent No. | Inventor | Issue Date |
|---|---|---|
| 532,032 | Dalumi | Jan. 8, 1895 |
| 554,837 | Seibert | Feb. 18, 1896 |
| 567,379 | Dalumi | Sept. 8, 1896 |
| 682,177 | Dalumi | Sept. 10, 1901 |
| 950,912 | Harrington | Mar. 1, 1910 |
| 1,004,810 | Newell, Jr. | Oct. 3, 1911 |
| 1,679 520 | Giroux | Aug. 7, 1928 |
| 1,731,164 | Giroux | Oct. 8, 1929 |
| 1,752,251 | Giroux | Mar. 25, 1930 |
| 1,765,215 | Duchard | June 17, 1930 |
| 2,628,838 | Smalley | Feb. 17, 1953 |
| 2,814,893 | Aiken | Dec. 3, 1957 |
| 3,410,011 | Bowman | Nov. 12, 1968 |
| 3,458,944 | Jimenez | Aug. 5, 1969 |
| 3,462,857 | Glass et al | Aug. 26, 1969 |
| 3,605,302 | Moller | Sept. 20, 1971 |
| 3,706,148 | Johnston | Dec. 19, 1972 |
| 3,740,878 | Oelschlaeger | June 26, 1973 |
| 4,063,377 | Hukill | Dec. 20, 1977 |

A display device utilizing an array of display elements having sides of contrasting colors is disclosed in the Dalumi U.S. Pat. No. 532,032. Each of the display elements is hingedly attached to the back wall of the sign, and includes a spring member which normally holds the display element in the down position. A cable is attached to each of the display elements to enable them to be rotated upwardly from a position remote from the sign. An electromagnet is positioned above each of the catches and when activated permits the display element to rotate to the down position.

Seibert discloses a calendar display device having a series of pigeon holes or compartments provided with hinged doors to which are attached a plurality of reversible date plates or tabs for indicating the days of the week and the months of the year. Dalumi U.S. Pat. No. 567,379 discloses yet another display device which has rotating panels that rotate from an up to a down position to form contrasting color displays. The device of the Dalumi patent includes a spring to provide for friction so that the display elements are not easily rotated.

In Dalumi U.S. Pat. No. 682,177 another changeable display sign is disclosed having a plurality of display elements. A spring is again provided for causing friction against the rotating shaft to make the rotation of the display elements difficult because of the friction exerted by the spring. Further, a stop is provided behind the sign to engage a knuckle on the rotating edge of the panel to maintain the panel in the orientation once the panel has been placed in that orientation. These stops are selectively engaged and disengaged by the user.

In the Harrington U.S. Pat. No. 950,912 a reversible sign display is disclosed wherein an outer frame has an inner frame which has an inner display sign which can be pivoted to show either side of the inner display sign that is supported by the outer display sign. In the Newell U.S. Pat. No. 1,004,810 there is disclosed a transmutable display device having a two dimensional array of display elements. Each of the display elements is generally two sided, the first being flat and the second being curved. The area between the two surfaces is open and the display elements are suspended on a framework which includes rods which pass through the opening between the two surfaces. The displays are altered by shifting the display element about the associated rod and allowing it to slide downwardly so that the rod is received at one junction or the opposite junction between the flat and round surfaces.

In the Giroux U.S. Pat. No. 1,679,520 the display device consists of a plurality of panels that are mounted about a shaft essentially through their center. They are rotated in either direction about the shaft that runs through their center. They are maintained in position by tabs that friction engage with adjoining display panels. The Glass U.S. Pat. No. 3,462,857 discloses a toy having triangular display elements which may be rotated about a central shaft so that any particular side of the display element can be shown to form various displays. The Giroux U.S. Pat. No. 1,731,164 discloses a changeable sign which again has a plurality of display elements which are triangular and have three display sides and are mounted by their centers on a shaft. The display elements are rotated about their centers so that any one of the triangular display surfaces is shown.

Giroux U.S. Pat. No. 1,752,251 discloses a display device similar to the device of the Giroux Pat. No. 1,731,164. A cushion is provided on the back wall so that the points of the triangular display portions friction engage against that cushion so that the opposite display side tends to remain in its orientation. The Duchard U.S. Pat. No. 1,765,215 discloses a display device having a plurality of panels that are pivoted about their center and remain in position because of tabs that engage with adjoining panels. The panels are mounted on two opposite chains which are mounted on gears so that the entire display device may be rotated about two gear positions to provide a moving display.

The Smalley U.S. Pat. No. 2,628,838 discloses a rotary blot game apparatus having a plurality of triangular display elements disposed in a frame. These display elements are pivoted about the central axis. The Aiken U.S. Pat. No. 2,814,893 discloses a display device having a plurality of display elements having two display sides which are pivoted into display position by the action of arms which engage a portion of the display element. The arms are engaged to a pivoting arm portion which has a cam follower on it. The cam follower follows a cam that is mounted to a shaft with a plurality of similar cams. Each particular arm for each coinciding display element is mechanically joined to different cams. Depending on the type of cam, when the rotation of the shaft to which all the cams are mounted occurs the arm will be moved so that a particular display side of the display element will be displayed. Aiken thus provides for a device whereby the cams can be selectively altered so that with one rotation of the shaft the particular arms can be appropriately moved by the cam follower means so that a particular and appropriate display occurs through the pivoting of the corresponding display elements.

The Bowman U.S. Pat. No. 3,410,011 discloses a triangular display element disposed about a central axis so that any one of the three sides of the display element will be displayed. The rear point of the triangle engages a foam or rubber material to cause friction so that the front part of the display element being displayed tends to stay in its orientation.

The Jimenez U.S. Pat. No. 3,458,954 discloses a display device having a plurality of pockets in which display elements may be received to form particular displays. The Moller U.S. Pat. No. 3,605,302 discloses a moveable display device having a plurality of elements mounted to a chain which are pivotable about their central axis to form a display and are moved along to form a moving display. The Johnson U.S. Pat. No. 3,706,148 discloses a display device having triangular display elements which have an open interior space which engages various support strips. The interior of the triangle has a ridge disposed at different locations to allow for sorting of the various display elements. The Oelschlaeger U.S. Pat. No. 3,740,878 discloses a display device in which the support member of the display device is also rotatable as well as the individual display elements of the support member.

The Hukill U.S. Pat. No. 4,063,377 is a patent that was issued to the present inventor on Mar. 29, 1976. It discloses a display device having a plurality of display elements which are rotatably mounted about their edges and also a means for providing for remote rotation of those display elements. A spring retention means is shown for holding the display element in one position, and the display element can be rotated by means of a cable into another position.

SUMMARY OF THE INVENTION

A changeable display device is displayed herein which comprises a support member and a plurality of display elements. Each of said display elements has a first display side, a second display side and an attaching edge, the attaching edge being mounted to the support member so that the display element is pivotable into a first display orientation and a second display orientation, whereby the first display orientation corresponds to the displaying of the first display side and the second display orientation corresponds to the displaying of the second display side. A camming member is connected to the display element adjacent the attaching edge, and spring means is connected to the support member adjacent the camming member for exerting a force against the camming member to urge the pivoting of the display element into the first or into the second display orientations and to restrain the pivoting of the display element out of the first or the second display orientations.

It is an object of the present invention to provide an improved changeable display device having integral elements which may be selectively adjusted to exhibit various expressions.

Another object of the present invention is to provide an improved changeable display device which may be quickly and conveniently adjusted.

Yet another object of the present invention is to provide an improved changeable display device which includes display elements which are maintained and biased into all of their display orientations.

Related objects and advantages of the present invention will become apparent from the description which follows.

DESCRIPTION OF THE PREFERRED EMBODIMENT

Figure 1:
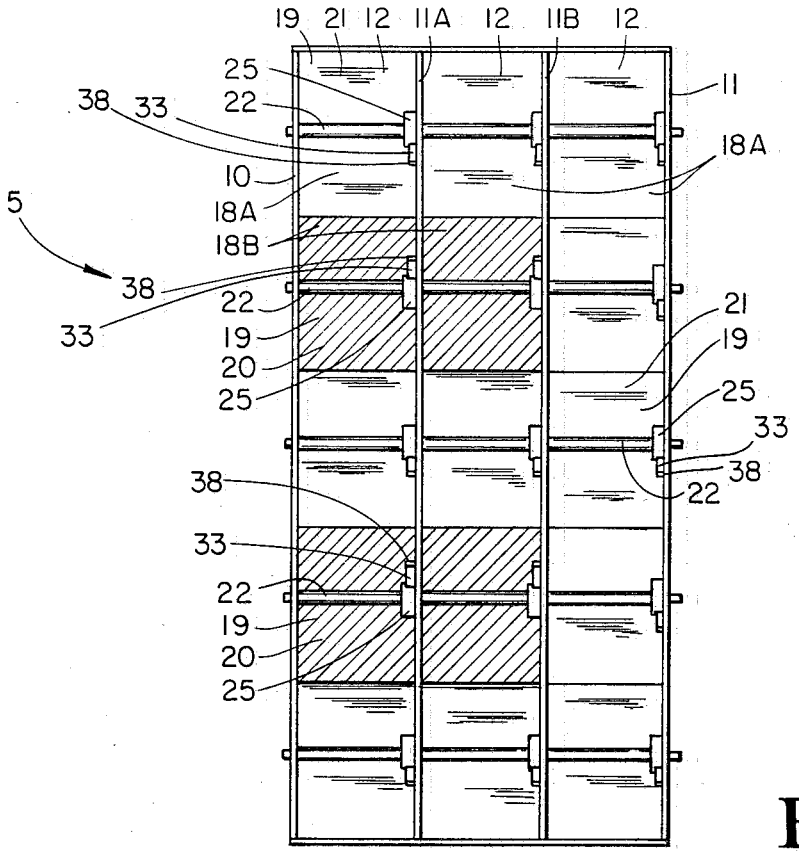
FIG. 1 is a front plan view of the display device of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
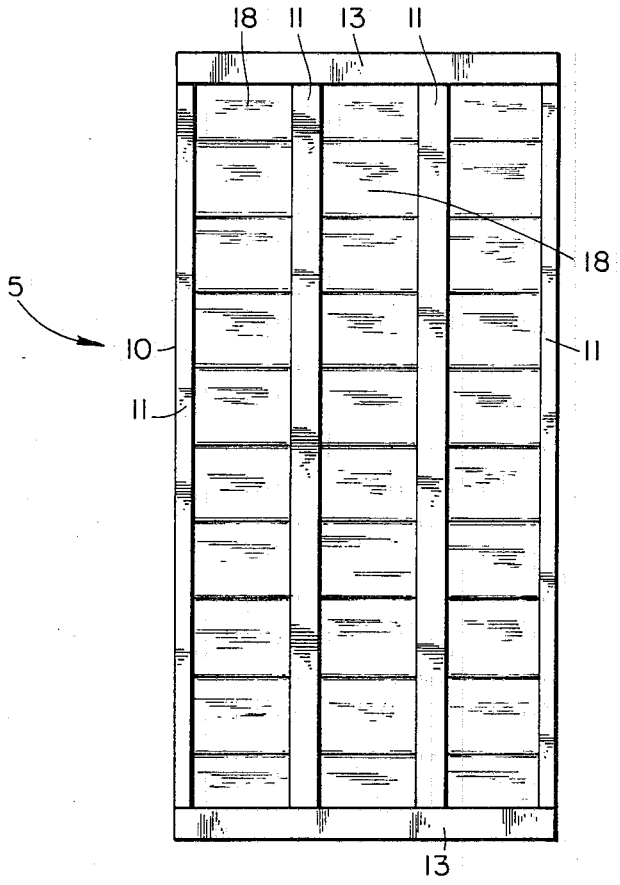
FIG. 2 is a back plan view of the display device of FIG. 1.
Figure 14:
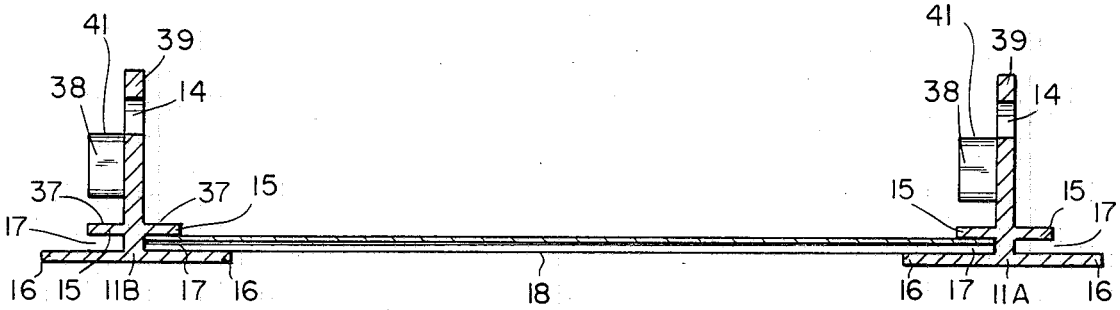
FIG. 14 is a top elevational view in cross section showing the rails and the back panels disposed within the back wall channels of the rails.

Referring to FIG. 1 there is shown a changeable display device 5. The changeable display device 5 includes a support member 10 which is constructed of an array of parallel rails 11. These rails 11 are arranged in a parallel array to form display channels 12 between adjacent rails 11, for example in FIG. 1, 11A and 11B, respectively. The rails 11 are maintained in the parallel array by cross members 13 which are welded to the rails as shown in FIG. 2. Each of these rails has a plurality of pin passageways 14 as shown in FIG. 14. These passageways 14 are disposed along the length of the rails 11 at evenly spaced intervals. It should be noted that the numbering on the drawings has been done only for representantive components and duplicates which are easily discernable as such have not been numbered.

The support member 10 constructed of the rails 11 and the cross members 13 has a back wall which is formed by a plurality of back wall plates 18. Each of said rails 11 has a back wall channel 17 (FIG. 14) for these back wall plates 18. This back wall channel 17 is formed by a top flange member 15 and an opposite parallel bottom flange member 16. Two adjacent rails 11A and 11B are disposed in the array so that the back wall channel 17 of rail 11A opposes the back wall channel 17 of rail 11B. The back wall plates 18 are then received within these opposing back wall channels of the two opposing rails as shown in FIGS. 2 and 14. In the preferred embodiment these plates 18 have a slight camber so that they are friction held within the back wall channel 17.

The plates 18 are held in place, as shown in FIG. 2, because the entire space of the channels 17 are filled up with adjacent plates 18 and because they are supported from the bottom by the flange 16 and from the top by the flange 15 and on the ends by adjacent plates and the cross members 13. In the preferred embodiment, some of the back wall plates 18A are a yellow color and some of the back wall plates 18B are a black color. The top horizontal row of back wall plates are black and the next row are yellow and the next row are black and so forth from the top to the bottom, row by row.

Within this support member 10 are mounted a plurality of display elements 19. These display elements 19 have opposite display sides 20 and 21. In the preferred embodiment display side 20 is colored black and display side 21 is colored yellow. The display element 19 also has an attaching edge 22 which has a first passageway 23 at one end and a second passageway 24 at the opposite end.

Figure 5:
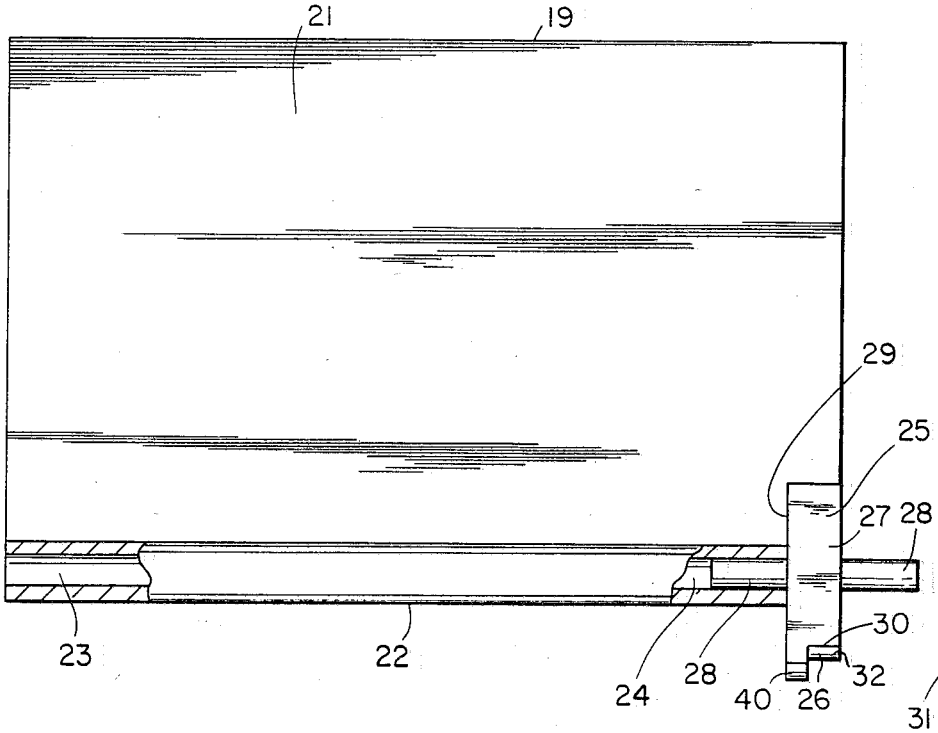
FIG. 5 is a front elevational view in partial cross section of a display element having a camming member attached thereto.
Figure 6:
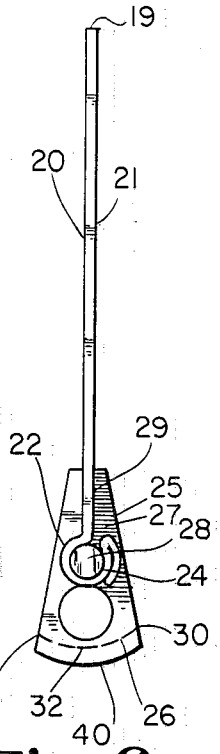
FIG. 6 is a side elevational view of the display element of FIG. 5.
Figure 7:
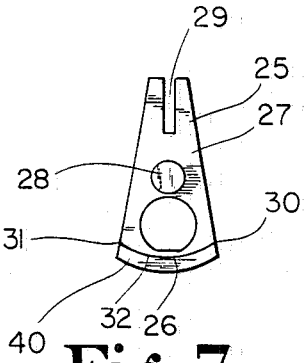
FIG. 7 is a front elevational view of a camming member.
Figure 8:
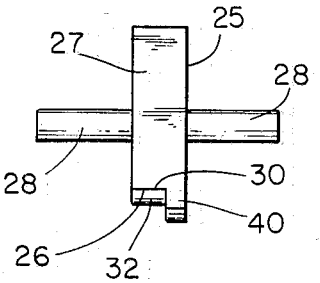
FIG. 8 is a side elevational view of the camming member of FIG. 7.

As shown in FIG. 5, adjacent its attaching edge 22, the display element has attached to it a camming member 25. This camming member has a camming surface portion 26 and a body portion 27. Extending from the body portion and away from the camming surface portion 26 are a pair of oppositely extending pins 28. The display elements 19 and the camming members 25 are attached by inserting one pin 28 within the attaching edge passageway 24 and by inserting the display element within the display element mating groove 29 of the camming member as shown in FIG. 6. By this attachment, when the camming member is rotated about an axis through the two pins 28 the display element 19 is also pivoted about that axis. The shape of the camming member is such that the camming surface portion 26 is disposed away from the axis of rotation of the pins 28.

Figure 3:
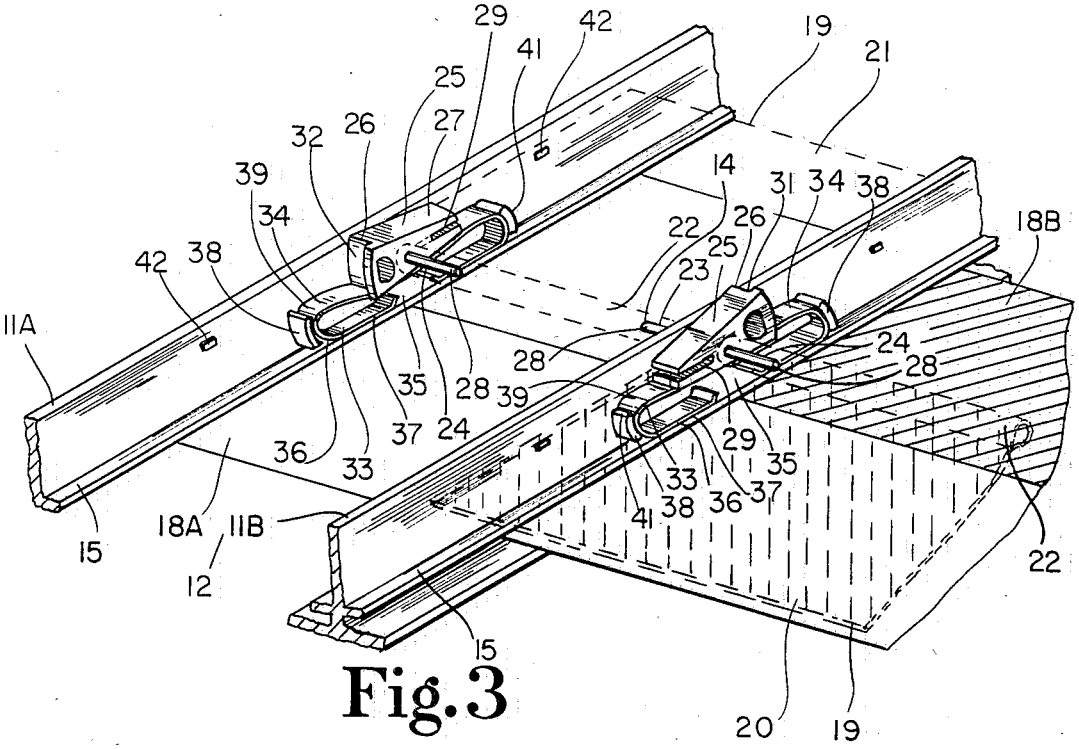
FIG. 3 is a perspective view of a portion of the display device of FIG. 1 showing portions of two display elements in phantom in a first and a second display orientation respectively and also showing the camming member and spring means disposed adjacent the attaching edge of the display elements.

The display elements 19 are mounted to the support member 10, in an array within the display channels 12 between the adjacent rails 11 as follows. The oppositely extending pin 28 is inserted within a pin passageway 14 of one rail, for example rail 11A. The attaching edge's other passageway 23 is aligned with the pin passageway 14 of the adjacent rail 11B. Another camming member display element assembly is disposed within the adjacent display channel 12 so that the pin 28 of that camming member passes through the pin passageway 14 of the rail 11B and is received within the passageway 23 of the attaching edge 22 of the other display element. A structure such as this is shown in FIG. 3.

The display elements 19 are thus pivotably mounted about the axis of the rotation of the pins 28 as they are mounted within the pin passageways 14. As shown in FIG. 3, in the preferred embodiment the display elements are thus rotatable into one of two display orientations. One being where the display side 21 is displayed by being the side which faces away from the back wall plates 18 and the other being where the display side 20 is displayed by being the side which faces away from the back wall plates 18.

As in FIG. 1 the display elements are mounted so that when the yellow display side 21 is being displayed the display element covers a back plate 18B and uncovers a yellow plate 18A. In this manner, a large yellow area is displayed. Similarly when the black display side 20 is displayed a yellow plate 18A is covered and a black plate 18B is uncovered to form a large black display. As shown in FIG. 1 the display elements can be pivoted as desired to cooperate with the back wall plates to form various displays. In FIG. 1 the numeral "3" is formed. It is to be understood that the display sides 20 and 21 and the back plates 18 can be arranged in any manner and may have any symbols or contrasting colors, so that various insignia, characters or numerals may be formed.

Figure 4:
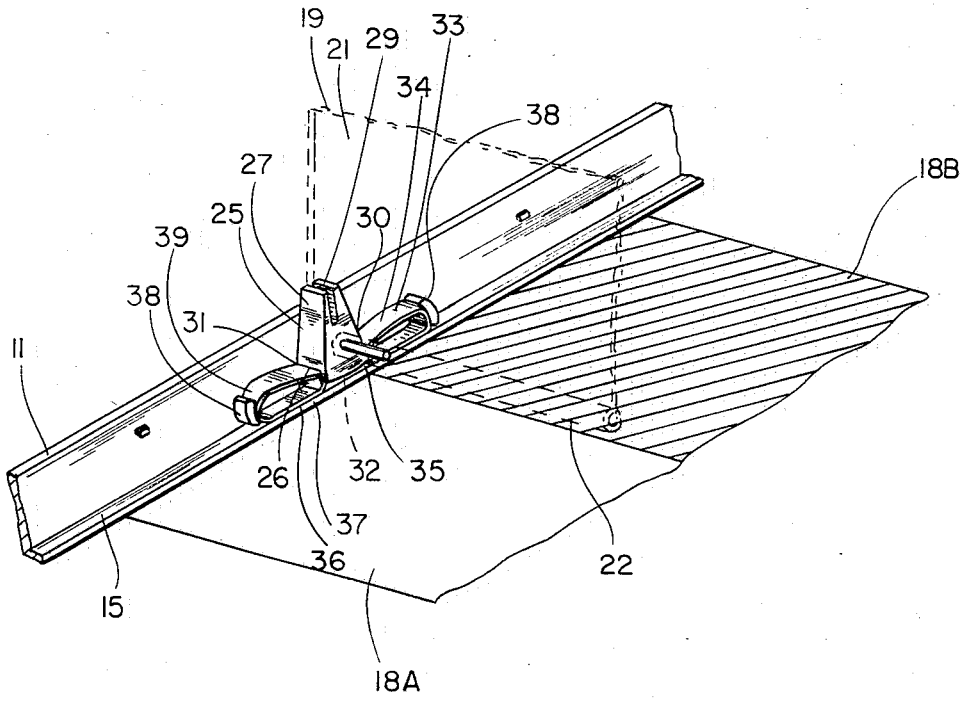
FIG. 4 is a perspective view of a portion of the display device of FIG. 1 showing a display element in phantom that is disposed at a point between a first and second display orientation and also showing the camming member and the spring means disposed adjacent the connecting edge.

The changeable display device 5 of the present invention also includes a spring means for exerting a force against the camming members 25. The camming surface portion 26 has two elbow portions 30 and 31 and an arcuate surface portion 32 between the elbow portions 30 and 31. The spring means, in the preferred embodiment, includes a spring member 33 which is a generally C-shaped as shown in FIGS. 3 and 4. The back of the C-shaped spring member 33 is a cam following portion 34. The C-shaped spring 33 is disposed within a spring housing 36 which is located adjacent and below the pin passageway 14. This spring housing 36 is constructed by the top wall 37 of the top flange 15 of the rail, the immediate side wall 39 of the rail and a pair of perpendicular flange portions 38 which are perpendicular to the side wall of the rail and generally perpendicular to the top flange wall 37 of the top flange member 15.

As shown in FIGS. 9 through 13 this C-shaped spring is disposed so that the open end 35 of the C-shaped spring 33 is against the wall 37 and so that the cam following back 34 is facing upwards from the spring housing 36. From the top, the C-shaped spring member 33 is retained within this spring housing 36 by the camming member surface 26. In the final direction to the side, the spring 33 is retained by a spring retention ridge 40 which is disposed on the camming member 25 adjacent the camming surface portion 26. The flanges 38 and the walls 37 and 39 and the ridge 40 are all nondeformable as well as the cam following surface 26. Thus, the C-shaped spring 33 is firmly in place in the spring housing and cannot be moved but can only be deformed by the action of the camming surface 26 on the cam following back 34 of the C-shaped spring 33.

As shown in FIGS. 9 through 13, the spring 33 exerts a force against the camming member 25 because it wishes to return to its undeformed state. This force is either exerted against the elbow areas 30 or 31 or against the generally arcuate camming surface portion 32 of the camming surface portion 26. Because the camming member 25 is maintained within the pin hole 14 by the pins 28, it can only rotate about the central axis of those pins 28. When the display element 19 is rotated from a first display orientation the camming member surface portion 26 will engage the cam following surface portion of the spring 27 and cause its deformation. The spring 33 exerts a force against the camming member surface portion 26 throughout the rotation. The effects of this force on the camming member can be best discerned from a review of FIGS. 9 through 13.

Figure 9:
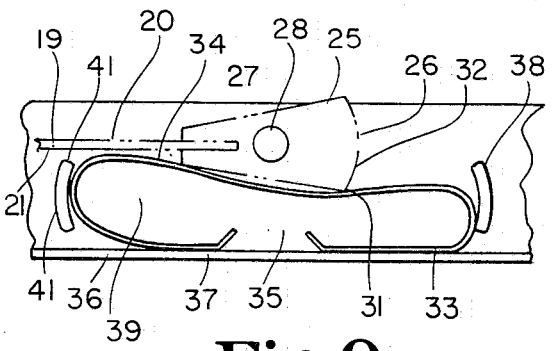
FIG. 9 is a side elevational view of the relation between a camming member and a C-shaped spring member when said display element would be in one of said display orientations.

In FIG. 9 the camming member and the spring are shown as they would be when the display element 19 is in one orientation. This orientation could correspond to the display orientation in which the side 20 is being shown as in FIG. 3. In this position most of the force exerted by the spring 33 is at the elbow camming portion 31. As the spring pushes upward on the camming member at the elbow 31 most of the force creates a levering action about the axis of pivoting of pin 28 so that the camming member is forced to pivot in a counterclockwise rotation. The display element 19 which is attached to the camming member is thus forced to pivot in a counterclockwise rotation and is forced into and retained in the display orientation. Additionally the display element 19 is forced against the flange 38 at the top of the flange 41 and is thus held in place on one side by the rigid flange 41 and its contact with the display side 21 of the display element 19 and is biased into and retained within that orientation by the force of the spring on the elbow 31.

Figure 10:
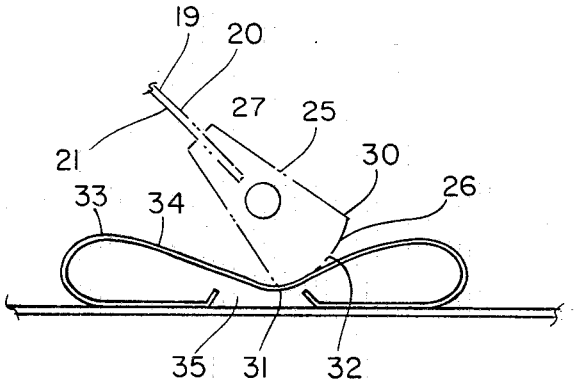
FIG. 10 is a side elevational view of the relation between a camming member and a C-shaped spring member when said display element is being biased into one of said display orientations.
Figure 11:
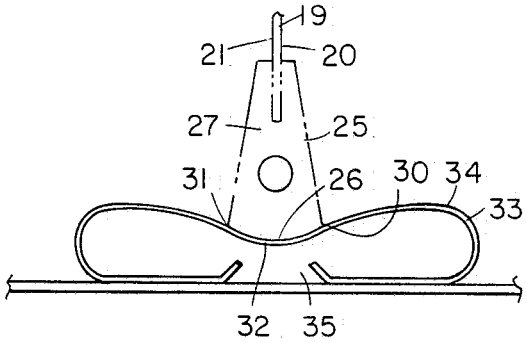
FIG. 11 is a side elevational view of the relation between a camming member and a C-shaped spring member when said display element is at a point between the first and second display orientations.

When the display element 19 is pivoted out of that orientation in a clockwise rotation the camming member 26 engages the spring 33 and deforms it to a greater extent as shown in FIG. 10. The camming portion 26 engages the cam following surface 34 of the spring at the elbow portion 31 and begins to engage at the arcuate portion 32. The effect of the camming member arcuate portion 32 engaging the spring is to direct more of the force directly through the axis of rotation of the pin 28. The display element becomes much easier to pivot because there is no need to continue to exert force to overcome the bending of the spring since the spring has been deformed to its greatest extent and is held there by the camming member rigidly held in place by the pin 28. Thus when the display element is in a particular display orientation the spring 33 is deformed to a lesser extent and it is deformed to a greater extent when the display element is pivoted between display orientations as shown in FIGS. 10 and 11.

Figure 12:
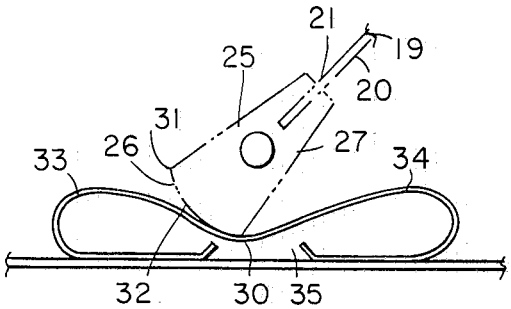
FIG. 12 is a side elevational view of the relation between a camming member and a C-shaped spring member when said second display element is being biased into another of said display orientations.
Figure 13:
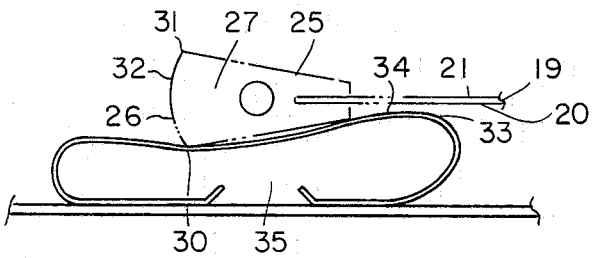
FIG. 13 is a side elevational view of the relation between a camming member and a C-shaped spring member when said display element would be in a second display orientation.

As the display element begins to pivot into the next display orientation where the display side 21 faces outward, as shown in FIG. 12, the spring begins to exert a force on the elbow portion 30. This creates a levering action which forces the display element to pivot in a clockwise direction and thus forces and biases it to snap into the other display orientation. Similarly in the second display orientation as shown in FIG. 13, the display element engages the top 41 of the flange 38 to stop it from rotating any further. The other display side 21 is now displayed. As described for FIG. 9, in FIG. 13 the spring similarly retains the display element in the new orientation and discourages its pivoting out of that orientation.

This simple device provides for a strong retention of the display element within all display orientations of the display element. It also provides for the biasing of the display element towards the display orientation once a certain angle is reached and for the easy shifting of the display element between orientations. A further feature which may be added are the protrusions 42 which are shown in FIG. 3. These protrusions can be added to the rails so the display element 19 will rub up against them when it is being pivoted out of a display orientation.

The friction caused by the protrusions will further enhance the retention of the display elements in the display orientation.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A changeable display device comprising:

a support member;

a plurality of display elements, each of said display elements having a first display side and a second display side and an attaching edge, said attaching edge being pivotally mounted to said support member so that said display element is pivotable into a first display orientation and a second display orientation whereby said first display orientation corresponds to the displaying of said first display side and said second display orientation corresponds to the displaying of said second display side;

a camming member connected to said display element adjacent said attaching edge;

spring means connected to said support member adjacent said camming member for exerting a force against said camming member to urge the pivoting of said display element into said first or into said second display orientations and to restrain the pivoting of said display element out of said first or said second display orientations;

said camming member has a camming surface portion and a body portion and said body portion being connected to said display element adjacent said attaching edge so that said camming surface portion is disposed away from the axis of pivoting of said display element and so that said spring means engages said camming surface portion and exerts said force against said camming surface portion; and said camming surface portion has a first surface elbow portion and an opposite second surface elbow portion whereby said camming member is urged to pivot into said first display orientation and restrained from pivoting out of said first display orientation when said force is exerted by said spring means engaging said camming surface portion at said first elbow surface portion and said camming member is urged to pivot into said second display orientation and restrained from pivoting out of said second display orientation when said force is exerted by said spring means engaging said camming surface portion at said second elbow surface portion.

2. The changeable display device of claim 1 wherein said camming surface portion has a generally arcuate surface portion between said first and second surface elbow portions whereby for a portion of the pivoting when said display element is pivoted between said first display orientation and said second display orientation said force is exerted by said spring means engaging said camming surface portion at said arcuate surface portion.

3. The changeable display device of claim 1 wherein said spring means includes a spring member having a cam following surface being deformable by the action of said camming member against said cam following surface, said spring member being mounted to said support member adjacent said camming member; and said spring member being deformed to a greater extent when said display element is between said first and second display orientations and deformed to a lesser extent when said display element is in either of said first or second display orientations.

4. The changeable display device of claim 3 wherein said spring member is generally C-shaped, and said cam following surface is the back portion of said generally C-shaped spring member.

5. The changeable display device of claim 3 wherein said camming member has a camming surface portion and a body portion and said body portion being connected to said display element adjacent said attaching edge so that said camming surface is disposed away from the axis of pivoting of said display element and so that said spring means engages said camming surface portion and exerts said force against said camming surface portion.

6. The changeable display device of claim 5 wherein said camming surface portion has a first surface elbow portion and an opposite second surface elbow portion whereby said camming member is urged to pivot into said first display orientation and restrained from pivoting out of said first display orientation when said force is exerted by said spring means engaging said camming surface portion at said first elbow surface portion and said camming member is urged to pivot into said second display orientation and restrained from pivoting out of said second display orientation when said force is exerted by said spring means engaging said camming surface portion at said second elbow surface portion.

7. The changeable display device of claim 6 wherein said camming surface has a generally arcuate surface portion between said first and second surface elbow portions whereby for a portion of the pivoting when said display element is pivoted between said first display orientation and said second display orientation said force is exerted by said spring means engaging said camming surface portion at said arcuate surface portion.

8. The changeable display device of claim 4 wherein said camming member has a camming surface portion and a body portion and said body portion being connected to said display element adjacent said attaching edge so that said camming surface is disposed away from the axis of pivoting of said display element and so that said spring means engages said camming surface portion and exerts said force against said camming surface portion; and said camming surface portion having a first surface elbow portion and an opposite second surface elbow portion and a generally arcuate surface portion between said first and second surface elbow portions whereby said camming member is urged to pivot into said first display orientation and restrained from pivoting out of said first display orientation when said force is exerted by said spring means engaging said camming surface portion at said first elbow surface portion and said camming member is urged to pivot into said second display orientation and restrained from pivoting out of said second display orientation when said force is exerted by said spring means engaging said camming surface portion at said second elbow surface portion.

9. A changeable display device comprising:

a support member having a back wall and a plurality of rails attached to said back wall in a parallel array to form a plurality of display channels between adjacent pairs of said rails;

a plurality of display elements, each of said display elements having a first display side and a second display side and an attaching edge, said attaching edge being rotatably mounted between an adjacent pair of said rails so that said plurality of display elements are disposed in an array in said plurality of display channels;

said display elements being pivotable into a first display orientation and a second display orientation whereby said first display orientation corresponds to the displaying of said first display side so that said first display side faces away from said back wall and said second display orientation corresponds to the displaying of said second display side so that said second display side faces away from said back wall;

a camming member connected to said display element adjacent said attaching edge;

spring means connected to said support member adjacent said camming member for exerting a force against said camming member to urge the pivoting of said display element into said first or into said second display orientations and to restrain the pivoting of said display element out of said first or said second display orientations;

said camming member has a camming surface portion and a body portion and said body portion being connected to said display element adjacent said attaching edge so that said camming surface is disposed away from the axis of pivoting of said display element and so that said spring means engages said camming surface portion and exerts said force against said camming surface portion;

said camming surface portion having a first surface elbow portion and an opposite second surface elbow portion and a generally arcuate surface portion between said first and second surface elbow portions whereby said camming member is urged to pivot into said first display orientation and restrained from pivoting out of said first display orientation when said force is exerted by said spring means engaging said camming surface portion at said first elbow surface portion and said camming member is urged to pivot into said second display orientation and restrained from pivoting out of said second display orientation when said force is exerted by said spring means engaging said camming surface portion at said second elbow surface portion;

said spring means includes a spring member having a cam following surface being deformable by the action of said camming member against said cam following surface, said spring member being mounted to said support member adjacent said camming member; and said spring member being deformed to a greater extent when said display element is between said first and second display orientations and deformed to a lesser extent when said display element is in either of said first or second display orientations.

10. The changeable display device of claim 9 wherein said spring member is generally C-shaped, and said cam following surface is the back portion of said generally C-shaped spring member.

11. The changeable display device of claim 9 wherein said camming member is connected to said display element at a point adjacent one of said adjacent pair of rails to which said display element is rotatably mounted; and said spring member being disposed adjacent said one of said adjacent pair of rails so that said cam following surface engages said cam surface portion as said display element pivots.

12. The changeable display device of claim 11 further comprising a spring housing connected to said one of said adjacent pair of rails, said spring housing having a back flange portion along said back wall and first and second flange portions extending from said rail and perpendicular to said back wall;

said spring member being generally C-shaped, and said cam following surface being the back portion of said generally C-shaped spring member and said spring member being received in said spring housing so that the open end of said C-shaped spring member faces said back flange portion.

13. The changeable display device of claim 12 wherein said camming member has a spring retention ridge along a side of said cam surface portion, said spring member is retained in said spring housing because it is surrounded by the rail on one side, the housing flanges on three other sides, the cam surface portion on another side and said spring retention ridge on the final side.

14. The changeable display device of claim 9 wherein said first and second display sides are contrasting in color.

15. The changeable display device of claim 9 wherein said attaching edge of said display elements has first and second passageways and said camming member has a first pin and an oppositely extending second pin;

said rails having a plurality of pin passageways;

said first pin being received in an attaching edge first passageway of a first display element and said second opposite pin xtending through one of said pin passageways in said rails and being received in an attaching edge second passageway of a second display element whereby said array of display elements may be pivotally mounted between said rails by a plurality of said camming members.

16. The changeable display device of claim 9 wherein said rails have a first and second flange means for forming first and second back wall channels on opposite sides of said rails;

said rails are held in said array by cross members perpendicular to said rails and the first back wall channel of a first rail of an adjacent pair of rails forming a display channel opposes the second back wall channel of a second rail of said adjacent pair of rails; and a plurality of plates disposed within said first back wall channel of said first rail of said adjacent pair of rails and disposed in said second opposing back wall channel of said second rail of said adjacent pair of rails so that said plates form said back wall.

17. A changeable display device comprising:

a support member;

a plurality of display elements, each of said display elements having a first display side and a second display side and an attaching edge, said attaching edge being pivotally mounted to said support member so that said display element is pivotable into a first display orientation and a second display orientation whereby said first display orientation corresponds to the displaying of said first display side and said second display orientation corresponds to the displaying of said second display side;

a camming member connected to said display element adjacent said attaching edge;

spring means connected to said support member adjacent said camming member for exerting a force against said camming member to urge the pivoting of said display element into said first or into said second display orientations and to restrain the pivoting of said display element out of said first or said second display orientations;

said camming member has a camming surface portion and a body portion and said body portion being connected to said display element adjacent said attaching edge so that said camming surface is disposed away from the axis of pivoting of said display element and so that said spring means engages said camming surface portion and exerts said force against said camming surface portion;

said spring means includes a spring member having a cam following surface being deformable by the action of said camming surface portion against said cam following surface, said spring member being mounted to said support member adjacent said camming member; and said spring member being deformed to a greater extent when said display element is between said first and second display orientations and deformed to a lesser extent when said display element is in either of said first or second display orientations.

* * * * *